US006044842A

United States Patent [19]

Pereira et al.

[11] Patent Number: 6,044,842

[45] Date of Patent: Apr. 4, 2000

[54] GASKETLESS CONNECTING ADAPTER

[76] Inventors: Michael Pereira, 28 Yates St., Lincoln, R.I. 02865; David Jarry, 82 Edmund St., Woonsocket, R.I. 02895; Anthony Ricci, 149 Cardinal Rd., Cranston, R.I. 02921

[21] Appl. No.: 09/081,534

[22] Filed: May 19, 1998

Related U.S. Application Data

[60] Provisional application No. 60/047,029, May 19, 1997.

[51] Int. Cl.[7] ..... A62B 9/04

[52] U.S. Cl. ..... 128/202.27; 128/206.17; 55/DIG. 33; 95/286; 95/287; 96/133

[58] Field of Search ..... 128/202.27, 205.27, 128/205.29, 206.12, 206.15, 206.17, 206.21; 55/323, 350.1, 482, 496, DIG. 33, DIG. 35, 501, 502, 503; 95/286, 287; 96/133

[56] References Cited

U.S. PATENT DOCUMENTS

| | | | |
|---|---|---|---|
| Re. 35,062 | 10/1995 | Brostrom et al. | 128/206.12 |
| 1,079,251 | 11/1913 | Macrini . | |
| 2,065,304 | 12/1936 | Cover | 128/206.15 |
| 2,130,555 | 9/1938 | Malcom | 128/206.15 |
| 2,227,959 | 1/1941 | Cover | 128/206.15 |
| 2,235,624 | 3/1941 | Schwartz | 128/206.15 |
| 2,320,770 | 6/1943 | Cover | 128/206.15 |
| 2,575,483 | 11/1951 | Bethig . | |
| 2,951,551 | 9/1960 | West | 55/DIG. 33 |
| 3,142,549 | 7/1964 | Klusewitz et al. . | |
| 3,347,026 | 10/1967 | Zankey . | |
| 4,088,461 | 5/1978 | Brauer . | |
| 4,248,613 | 2/1981 | Linhart . | |
| 4,494,538 | 1/1985 | Ansite . | |
| 4,886,058 | 12/1989 | Brostrom et al. | 128/206.12 |
| 4,921,512 | 5/1990 | Maryyanek et al. . | |
| 4,934,361 | 6/1990 | Michel et al. . | |
| 5,036,844 | 8/1991 | Pouchot et al. . | |

FOREIGN PATENT DOCUMENTS

| | | | |
|---|---|---|---|
| 0164946 | 12/1985 | European Pat. Off. | 128/206.17 |
| 2100661 | 7/1972 | France | 128/206.15 |
| 2720681 | 11/1978 | France | 128/206.17 |

*Primary Examiner*—John G. Weiss
*Assistant Examiner*—Joseph F. Weiss, Jr.
*Attorney, Agent, or Firm*—Sampson & Associates

[57] ABSTRACT

The present disclosure is directed to a gasketless connecting filter adapter (20, 40) for airtight joining of a first filter (23) to a second filter (33). The invention includes a flexible cover element (42) being adapted to seal at a first face surface (41) thereof over the face of a first filter (23), and including a second face surface (55) having a recessed central aperture (59) therein. Disposed in the central aperture (59) are connection apparatus for mating with and securing thereto the second filter such that air passes through the second filter (23) into the first filter (33). The second face surface (55) further includes an integral and axially extending resilient lip seal (39) being adapted to sealingly engage the second cartridge (33). The present invention may be of one or preferably two piece molded construction, of particular cross section.

21 Claims, 7 Drawing Sheets

GASKETLESS CONNECTING ADAPTER

This application claims benefit of Provisional Application Ser. No. 60/047,029 filed May 19, 1997.

TECHNICAL FIELD

The present invention relates to personal safety inhalation equipment, particularly breathing mask filters. More particularly, the present invention relates to an adapter attachable at a first surface to a gas/vapor filter cartridge and at a second surface to a particulate filter cartridge wherein no gaskets are required to seal the adapter to either cartridge.

BACKGROUND OF THE INVENTION

There exists a need for dual particulate and gas/vapor removing protection in the personnel safety market. Three types of gas/particulate combination filter assemblies are known.

Of these assemblies, the first 100 (FIG. 5) includes a simple sheet of particulate filter material or media 102 held between a gas/vapor cartridge 104 and a hard plastic cover 106 joined to the cartridge. Sealing of the media 102 is sometimes imperfect between the cover 106 and the cartridge 104. Similarly, the cover 106 occasionally does not fit properly onto the cartridge 104, especially where the media 102 is not placed with care.

In another configuration 200 (FIG. 6), a particulate cartridge 102 is simply joined permanently to the face of a gas/vapor cartridge 104, in effect "piggy-backing" the two together as a single unit 200 with two stages of filtration. However, the two cartridges may not have the same useful lives under differing environmental conditions.

It is also known (FIG. 7) to use a connecting adapter to join a particulate filter to a gas/vapor cartridge. In one example, a hard plastic adapter 300 is shaped to fit onto a gas/vapor cartridge 302 with a soft, flexible gasket 304 interface to provide an airtight seal between the cartridge 302 and the adapter. The adapter 300 is provided with a bayonet connector 306 for mating with a similar connector 308 on a particulate filter 308. Another soft, flexible gasket 310 is required to ensure that an airtight seal is accomplished between the adapter 300 and the particulate filter 308. With wear, the seals 304, 310 must be replaced to retain assurance of an effective seal. Also, worn seals 304, 310 become more subject to damage and/or loss. Use of the adapter 300 without seals 304 or 310 may be harmful or even hazardous. It is believed that such adapters are available from 3M, St. Paul, Minn., under manufacturer's part number 502.

SUMMARY OF THE INVENTION

According a first aspect of the present invention, a gasketless filter adapter is provided for airtight joining of a first filter to a second filter. The gasketless filter adapter includes:

a flexible cover element being adapted to seal at a first face surface thereof over a face of a first filter;

a second face surface having a central aperture therein;

a fastener operatively associated with the central aperture for mating with and securing thereto the second filter such that air passes through the second filter into the first filter;

the second face surface being adapted to sealingly engage the second filter.

In a second aspect of the present invention, a filter adapter for airtight joining of a first filter to a second filter of a breathing mask includes:

a flexible cover element having:

a female connector portion being adapted to sealably receive the face of a first filter therein; and a male connector portion being adapted to sealably engage the second filter such that air passes through the second filter into the first filter;

wherein the connecting filter adapter joins the first filter to the second filter in a gasket-free and airtight manner.

In a further aspect of the present invention, a method of assembling first and second filter elements includes the steps of:

(a) providing a gasketless filter adapter having:

(I) a flexible cover element being adapted to seal at a first face surface thereof over a face of a first filter;

(ii) a second face surface having a central aperture therein;

(iii) a fastener operatively associated with the central aperture for mating with and securing thereto the second filter such that air passes through the second filter into the first filter, wherein the second face surface is adapted to sealingly engage the second filter;

(b) sealing the first face of the flexible cover element over the face of the first filter; and (c) mating with and securing the fastener to the second filter, wherein the first filter is joined in a gasket-free and airtight manner to the second filter.

BRIEF DESCRIPTION OF THE DRAWING FIGURES

The features and advantages of the present gasketless connecting adapter will be more clearly appreciated from the following description of the preferred embodiments of the invention taken in conjunction with the accompanying drawing figures, in which like reference numerals indicate like elements, and wherein.

DETAILED DESCRIPTION OF THE PREFERRED EMBODIMENTS

Figure 1:
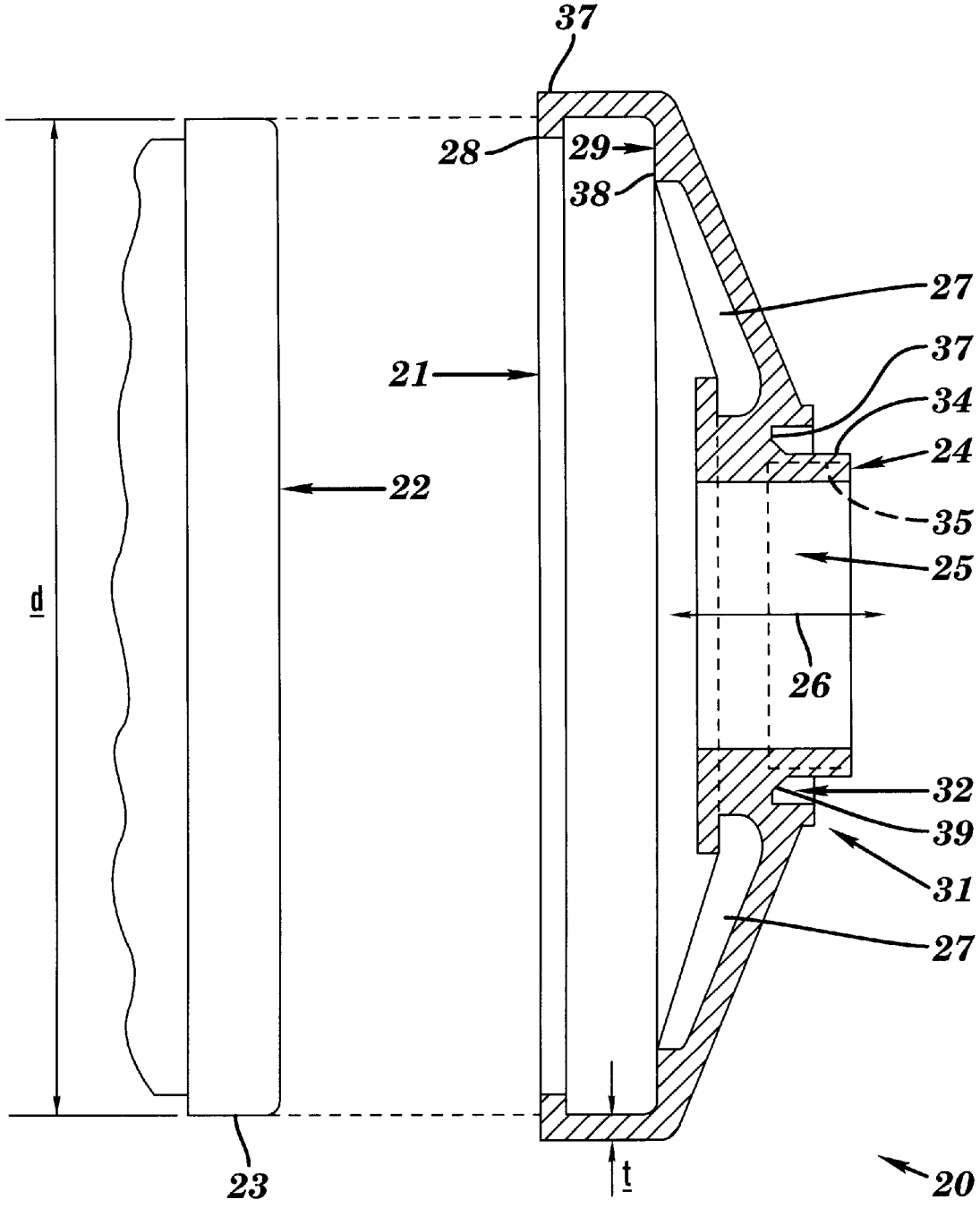
FIG. 1 is an exploded view of a filter and a one-piece embodiment of the connecting adapter of the present invention in cross-sectional view.
Figure 4:
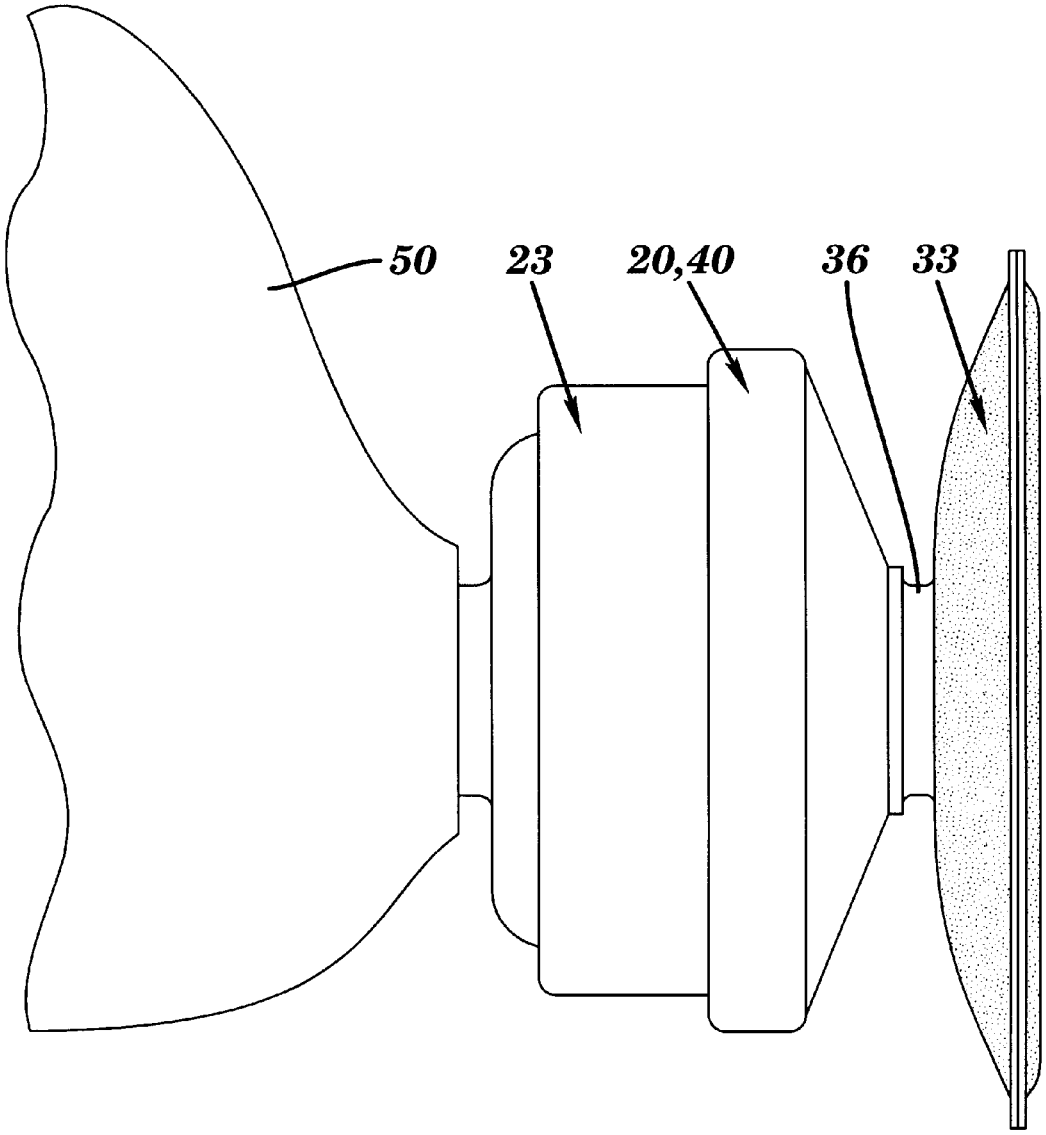
FIG. 4 illustrates an adapter according to the present invention joining a particulate filter to a gas/vapor filter mounted on a face mask.
Figure 5:
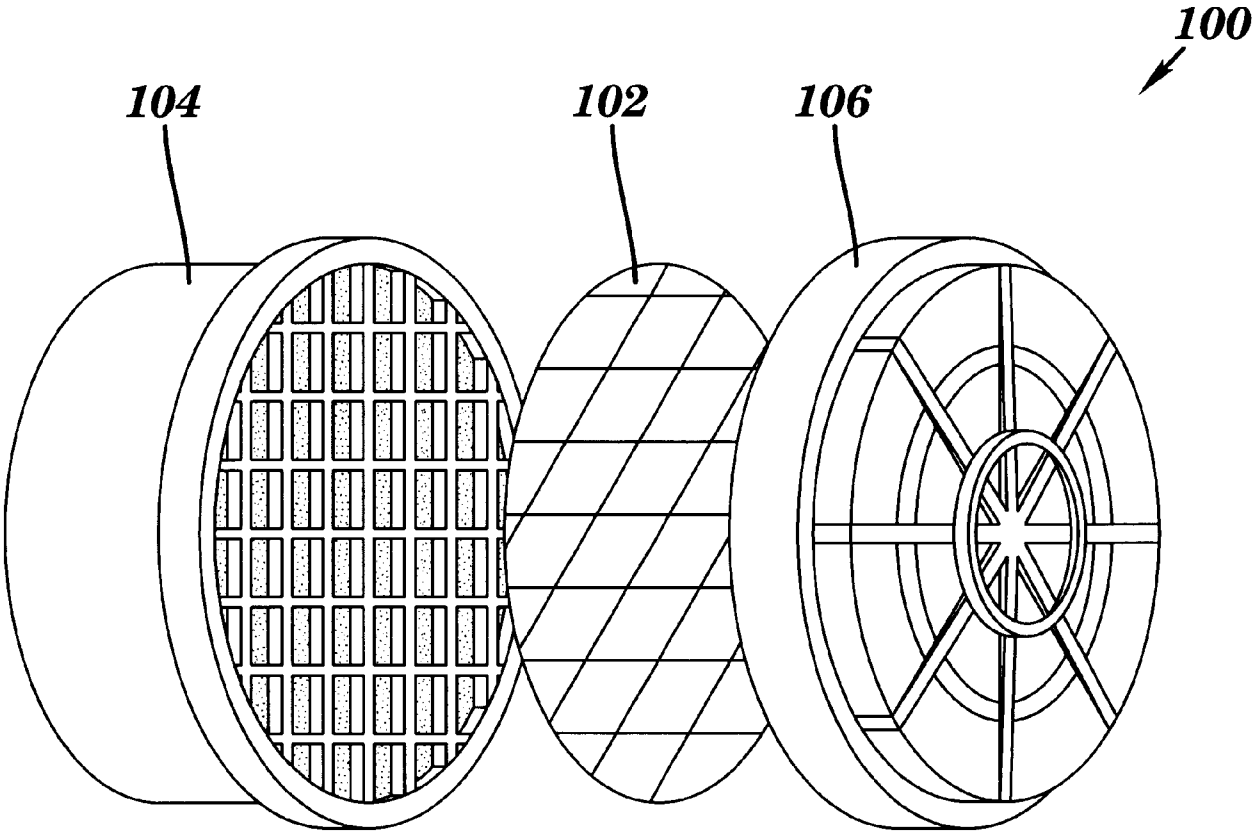
FIG. 5 PRIOR ART
FIG. 5 is an exploded perspective view of a prior art solution to the problem addressed by the present invention.
Figure 6:
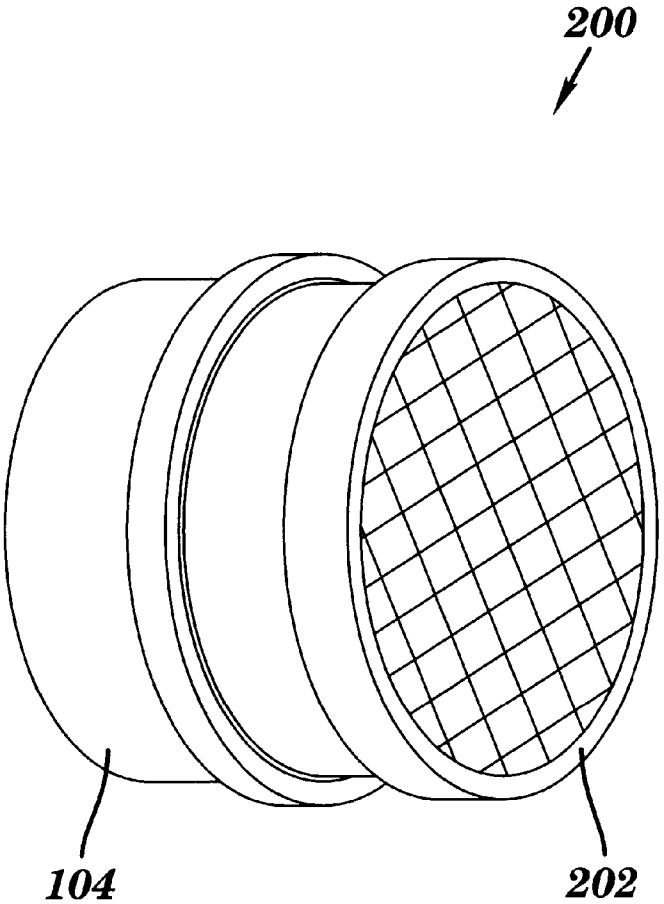
FIG. 6 PRIOR ART
FIG. 6 is a perspective view of another prior art solution to the problem addressed by the present invention.
Figure 7:
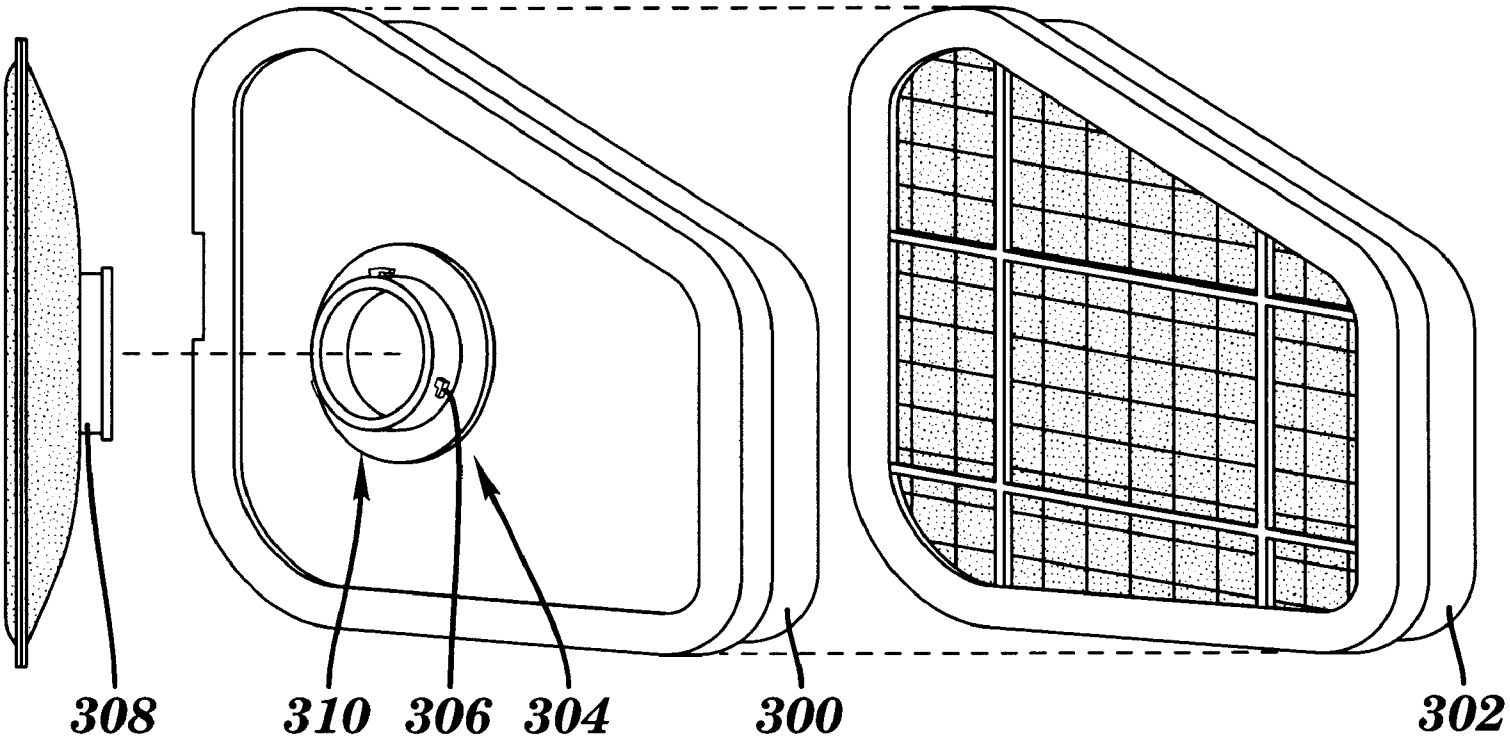
FIG. 7 PRIOR ART
FIG. 7 is an exploded partially perspective, partially elevational view of a further prior art solution to the problem presented by the present invention.

In the one-piece embodiment illustrated in FIGS. 1 and 4, the connecting adapter 20 includes a first concave or recessed end face 21 adapted to fit over the face 22 of a filter or gas/vapor cartridge 23 and snap into place. Where used in this disclosure, the term "filter" shall refer to any device adapted to remove material from a fluid such as air. Examples of "filters" as used herein include mechanical particulate filters and gas/vapor cartridges or vapor absorbing elements. The connecting adapter 20 according to this embodiment is made of a resilient, thermoplastic elastomer (TPE), as will be discussed hereinafter. Such material is durable and facilitates easy installation and removal from the gas/vapor cartridge a multiplicity of times. A centrally located aperture 24 is provided to form a through-passageway 25 for air flow as indicated by double-ended arrow 26.

Multiple axial spacing ribs 27 may be provided to ensure the interior of the first face 21 does not obstruct airflow between the through-passageway 25 and the gas/vapor cartridge 23. These ribs may be annular, radial as shown, or of another configuration. A lip 28 extending radially inward of the periphery 30 of the first face 21 ensures both a tight snap-fit and the acquisition of an airtight fit of the connecting adapter 20 to the gas/vapor cartridge 23. An internal peripheral flange 30 having a wide flat area 29 is provided to ensure an airtight seal against the gas/vapor cartridge 23 front face 22.

Formed into the second (opposing) face 31 of the connecting adapter 20 is an annular recess 32 that terminates at an annular seat 37. Recess 32 is configured to accept the particulate filter 33, whether of the cartridge or "flat" configuration. The through-passageway 25 in recess 32 permits air to pass from the particulate filter 33 and enter onto the front face 22 of the gas/vapor cartridge 23.

To ensure a secure fit of the particulate filter 33 onto the adapter 20, the through-passageway 25 includes an outer periphery 34 which includes suitable mating connections 35 joining with the particulate filter connector 36. Note that any suitable filter connection configuration can be used, including threaded elements as shown. Bayonet elements, or in a suitable configuration, both threaded and bayonet connections may be provided (not shown). For example, a through-passageway having an external bayonet mounting may include internal threads, while a through-passageway having an internal bayonet mounting may include external threads.

A lip 39 extending from seat 37, circumjacent the adapter through-passageway 25 and extending axially toward the particulate filter 33 may be provided to help ensure that a secure seal is accomplished when the particulate filter 33 connector 36 is seated against the adapter.

As mentioned hereinabove, adapter 20 is preferably fabricated from a rubber or thermoplastic elastomer such as, for example, natural rubber, styrene-butadiene rubber, polyisoprene rubbers, polybutadiene rubbers, ethylene-propylene terpolymer, neoprenes, nitrile rubbers, polyurethanes, silicone rubbers, polyacrylate rubbers and fluoroelastomers. Suitable materials may have a durometer hardness within a range of approximately 50–80 (Shore A) and preferably within a range of 60–70. Durometer hardness measurements generally correlate to the elastic modulus or resiliency of rubber compounds under conditions of relatively small strain. Since the present invention is utilized under relatively low levels of strain, i.e. nominally less than a 50 percent change in length, the durometer hardness generally correlates to the elastic modulus of a material used in the present invention.

A durometer hardness within the above range, in combination with a predetermined wall thickness t and the aforementioned snap or interference fit, enables adapter 20 to apply a leak-free fit to the filters, while permitting the adapter to be elastically tensioned or stretched to a predetermined extent to facilitate installation and removal from the filters. Moreover, wall thickness t is preferably predetermined to be large enough that the fixture is self supporting, i.e. that it does not collapse under its own weight prior to engagement with the filters. Thickness t may be larger than this minimal "self-supporting" thickness, though the skilled artisan will recognize that increasing thickness t will tend to increase the force required to elastically deform the fixture and thus may require use of a material having a lower durometer hardness or modulus of elasticity.

Figure 2:
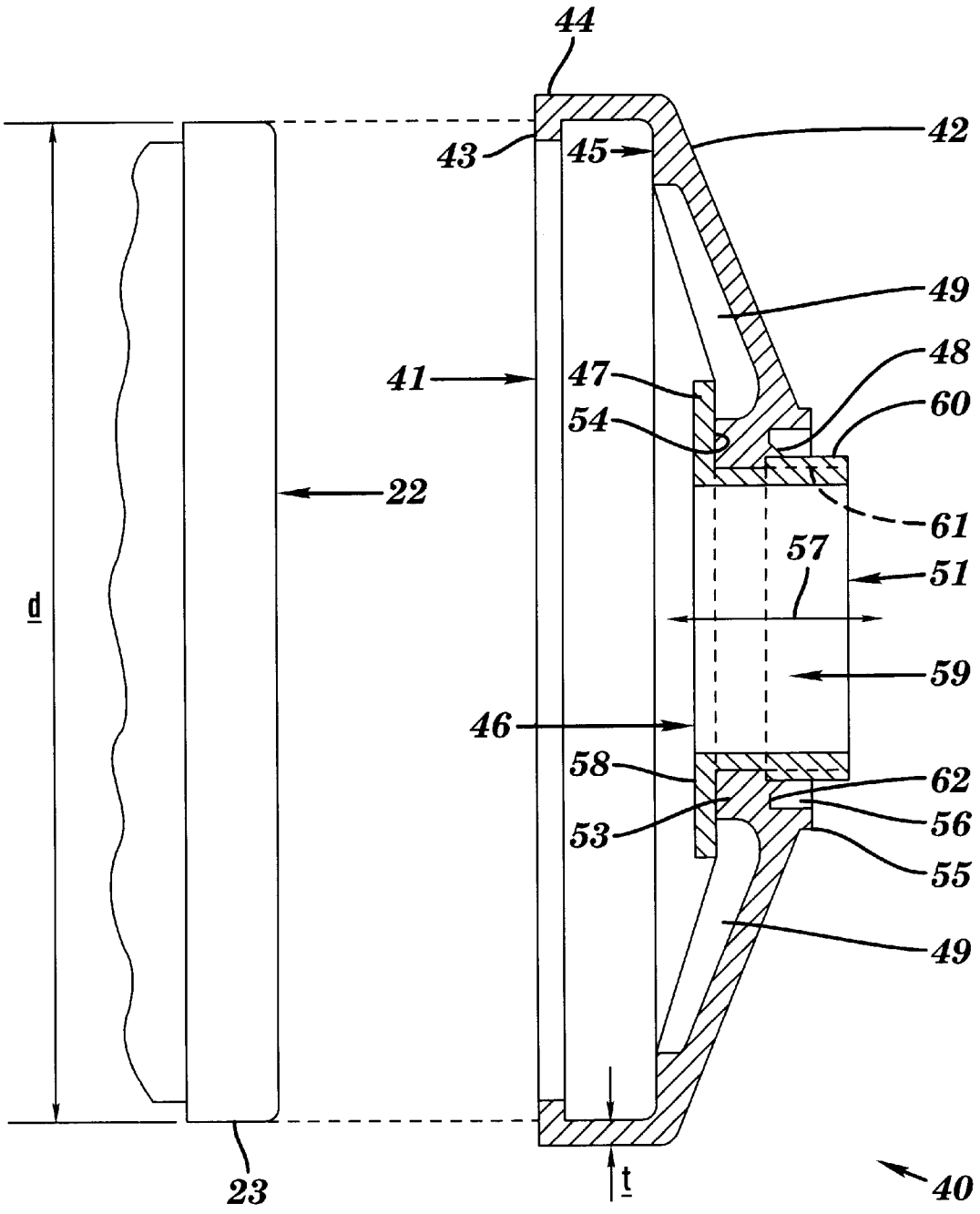
FIG. 2 is a view similar to that of FIG. 1, of a two-piece embodiment of the connecting adapter of the present invention.
Figure 3:
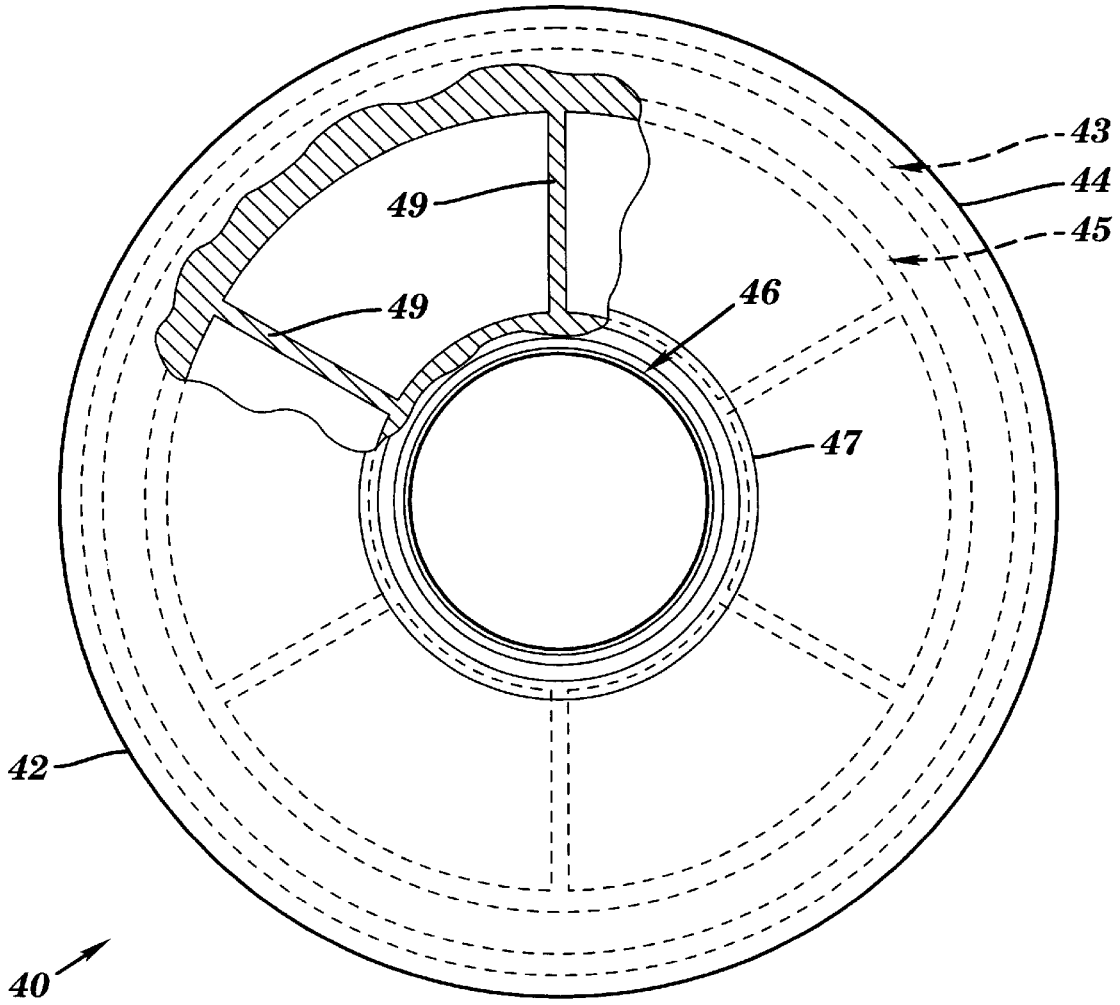
FIG. 3 is a plan view of the present invention in plan view, seen from a second end, with portions shown in phantom and portions broken away to illustrate spacing ribs.

In a second embodiment of the present invention illustrated in FIGS. 2–4, adapter 40 comprises a first concave or recessed end face 41 formed into a first piece 42 and adapted to fit over a gas/vapor cartridge 23 and snap into place. The first piece 42, or greater portion of the connecting adapter 40 according to this second embodiment is made of the same material and thickness t as adapter 20 discussed above, i.e. a resilient, thermoplastic elastomer (TPE). Such material is durable and facilitates easy installation and removal from the gas/vapor cartridge a multiplicity of times.

In one example, first piece 42 according to the present invention was provided with a wall thickness t of approximately 1–2 mm and fabricated from a Styrene Ethylene-Propylene Styrene elastomer having a durometer of between 60–70 Shore A, sized and shaped to engage a filter 22 having a diameter d of approximately 8 cm.

A lip 43 extending radially inward of the periphery 44 of the first face 41 ensures both a tight snap-fit and the acquisition of an airtight fit of the connecting adapter 40 to the gas/vapor cartridge 23. An internal peripheral flange having a wide flat area 45 is provided to ensure an airtight seal against the gas/vapor cartridge 23 front face 22.

A centrally located aperture 46 in first piece 42 is provided that forms a seat for the second piece 47, which bears the particulate filter 33 connection element 36 or elements, as is discussed hereinafter. This second piece 47 is manufactured of a suitably stronger material, such as a stiff resin based plastic or thermoplastic, i.e. styrene, acrylics, cellulosics, polyethylenes, vinyls, nylons, and fluorocarbons; polyvinyl chloride; polyethylene; urea-formaldehyde; metal; fiberglass; or the like. As with the one-piece connecting adapter 20 previously described, multiple axial spacing ribs 49 may be provided to ensure the interior of the first face 41 does not obstruct airflow through the central aperture 51 thereof and to the gas/vapor cartridge 23. These ribs may be annular, radial as shown, or of another configuration. The inner periphery 53 of the central aperture 46 is provided with a thickened area forming the seat 54 for added strength in support of the second piece 47, and also provides a wide surface area against which the second piece 47 rests for ensuring a reliable, airtight seal.

Formed into the second (opposing) face 55 of the connecting adapter 40 is an annular recess 56 that terminates at an annular seat 62. Recess 32 is configured to accept the particulate filter 33 connection element 36. This recess 56 permits air to pass from the particulate filter and enter the face 22 of the gas/vapor cartridge 23 as indicated by double-ended arrow 57.

The second piece 47 of the connecting adapter 40 according to this embodiment thus comprises a short tubiform element having a radially extending flange 58 at its first end as previously described. The through-passageway 59 through the piece 47 directs air to the face 22 of the gas/vapor cartridge 23.

To ensure a secure fit of the particulate filter 33 onto the adapter 40, the second end of the piece 47 includes an outer periphery 60 which includes suitable mating connections 61 adapted for joining with the particulate filter 33 connection element 36. As with the earlier described one-piece embodiment, any suitable filter connection configuration can be used, including both threaded elements and bayonet elements, or in a suitable configuration, both threaded and bayonet connections may be provided.

A lip or seat 48 extending from seat 62 circumjacent central aperture 46 in the first piece 42 and extending axially toward the particulate filter 33 may be provided to ensure that a secure seal is accomplished when the particulate filter is seated thereagainst.

FIG. 4 illustrates the adapter 20 or 40 snap-fit over a cartridge 23, joining a particulate filter 33 to a mask 50. The filter connection element 36 joins the filter 33 to adapter 20 or 40.

Advantageously, the present invention provides a gasketless adapter 20, 40 for fastening two filter elements to one another. Furthermore, the adapter 20, 40 advantageously provides resilience to the dual filter assembly to help absorb impacts such as may occur in the event a user is working in physically tight or crowded conditions and inadvertently bumps the respirator into an object or person, etc. In such an event, the resiliency of the adapter tends to absorb the impact and maintain a tight seal between the respirator and the user, rather than dislodge the respirator and break the seal.

Although only preferred embodiments of the present invention are specifically illustrated and described herein, it will be appreciated that many modifications and variations of this present invention are possible in light of the above teachings and within the purview of the appended claims without departing from the spirit and intended scope of the invention.

We claim:

1. A gasketless filter adapter for airtight joining of a first filter to a second filter, said gasketless filter adapter comprising:

a flexible substantially air impermeable cover element being adapted to seal at a first face surface thereof over a face of a first filter;

a second face surface having a central aperture therein;

a fastener operatively associated with said central aperture for mating with and securing thereto the second filter such that air passes through the second filter into the first filter;

the second face surface being adapted to sealingly engage the second filter.

2. The gasketless filter adapter of claim 1, further comprising at least one rib disposed on an interior surface thereof, said rib being adapted to space the interior surface from at least one of the first filter and the second filter.

3. The gasketless filter adapter of claim 1, wherein said fastener comprises threaded elements being adapted to threadably engage the second filter.

4. The gasketless filter adapter of claim 1, further comprising an internal peripheral flange being adapted for surface to surface engagement with the face of the first filter.

5. The gasketless filter adapter of claim 4, further comprising a retention lip extending radially inwardly from a periphery of said first face surface, wherein said first face surface is being adapted to resiliently capture a portion of the first filter between said retention lip and said internal peripheral flange.

6. The gasketless filter adapter of claim 1, wherein said second face surface further comprises a resilient filter seat disposed circumjacent said central aperture, and being adapted to sealingly engage the second filter.

7. The gasketless filter adapter of claim 6, wherein said filter seat further comprises a lip seal extending integrally, substantially axially from said second face surface.

8. The gasketless filter adapter of claim 6, further comprising an annular recess disposed on said second face circumjacent said central aperture, said annular recess being adapted to receive a portion of the second filter therein to form said filter seat.

9. The gasketless filter adapter of claim 8, wherein when said filter seat further comprises a lip seal extending integrally, substantially axially from said second face surface.

10. The gasketless filter adapter of claim 8, wherein said lip seal is disposed radially inward and concentrically with said annular recess.

11. The gasketless filter adapter of claim 1, wherein said cover element is discrete from said fastener.

12. The gasketless filter adapter of claim 11, wherein said fastener comprises a tube being adapted to extend through said central aperture, said tube having a flange disposed at one end thereof for engaging said cover element about a periphery of said central aperture, an other end of said tube being adapted to engage the second filter wherein said cover element is adapted for being captured in an airtight manner between said flange and the second filter.

13. The gasketless filter adapter of claim 12, wherein said periphery of said central aperture forms a flange seat being adapted for surface to surface engagement with said flange.

14. The gasketless filter adapter of claim 12, further comprising a resilient lip seal disposed circumjacent said central aperture, extending integrally, axially from said second face surface and being adapted to sealingly engage the second filter, wherein when said cover element is captured, said flange seat is engaged with said flange and said resilient lip seal is engaged with the filter.

15. The gasketless filter adapter of claim 12, wherein said fastener is fabricated from a substantially rigid material.

16. The gasketless filter adapter of claim 15, wherein said fastener is fabricated from a material selected from the group consisting of: thermoplastics, i.e. styrene, acrylics, cellulosics, polyethylenes, vinyls, nylons, and fluorocarbons; polyvinyl chloride; polyethylene; urea-formaldehyde; metal; and fiberglass.

17. The gasketless filter adapter of claim 12, wherein said cover element is fabricated from a thermoplastic elastomer.

18. The gasketless filter adapter of claim 17, wherein said cover element is fabricated from a material selected from the group consisting of silicone, natural rubber, neoprene, styrene-butadiene rubber, polyisoprene rubber, polybutadiene rubber, ethylene-propylene terpolymer, nitrile rubber, polyurethane, polyacrylate rubber, fluoroelastomers, and styrene ethylene-propylene styrene elastomer.

19. The gasketless filter adapter of claim 17, wherein said cover element is fabricated from a material having a durometer hardness within a range of from 50 to 80 Shore A.

20. A filter adapter for airtight joining of a first filter to a second filter of a breathing mask, said filter adapter comprising:

a flexible substantially air impermeable cover element including:

a female connector portion being adapted to sealably receive the face of a first filter therein;

a male connector portion being adapted to sealably engage the second filter such that air passes through the second filter into the first filter;

wherein said connecting filter adapter joins the first filter to the second filter in a gasket-free and airtight manner.

21. A method of assembling first and second filter elements, said method comprising the steps of:

(a) providing a gasketless filter adapter including:

(i) a flexible substantially air impermeable cover element being adapted to seal at a first face surface thereof over a face of a first filter;

(ii) a second face surface having a central aperture therein;

(iii) a fastener operatively associated with said central aperture for mating with and securing thereto the second filter such that air passes through the second filter into the first filter, wherein the second face surface is adapted to sealingly engage the second filter;

(b) sealing the first face of the flexible substantially air impermeable cover element over the face of the first filter; and (c) mating with and securing the fastener to the second filter, wherein said first filter is joined in a gasket-free and airtight manner to the second filter.

* * * * *